United States Patent [19]

Elson

[11] Patent Number: 4,911,383

[45] Date of Patent: Mar. 27, 1990

[54] KITE

[76] Inventor: Lloyd C. Elson, R.R. #8, Parkhill, Ontario, Canada, N0M 2K0

[21] Appl. No.: 306,354

[22] Filed: Feb. 6, 1989

[51] Int. Cl.[4] ..... B64C 31/06

[52] U.S. Cl. ..... 244/153 R; 244/155 R; 244/155 A; 244/93

[58] Field of Search ..... 244/153 R, 155 R, 155 A, 244/154, 93, 16

[56] References Cited

U.S. PATENT DOCUMENTS

| | | | |
|---|---|---|---|
| 634,386 | 10/1899 | Zimmerman | 244/153 R |
| 642,451 | 1/1900 | Hoyt et al. | 244/153 R |
| 2,575,157 | 11/1951 | Berthene | 244/155 R |
| 3,356,322 | 12/1967 | Roos | 244/155 R |
| 3,951,363 | 4/1976 | Grauel | 244/153 R |
| 4,183,481 | 1/1980 | Elson | 244/155 R |
| 4,369,939 | 1/1983 | Elson | 244/155 R |

*Primary Examiner*—Galen Barefoot
*Attorney, Agent, or Firm*—Rogers & Scott

[57] ABSTRACT

The invention provides a kite, particularly an article dropping kite, consisting of a kite body, which usually is provided with a downwardly-extending kite keel to which is connected the kite string. The kite is provided with an article holding and releasing means consisting of a flexible-walled pocket, usually forwardly-opening, which is closed by the tension on the kite string to hold the article in the pocket during launch and flying. Upon release of the tension the pocket tends to open, assisted by entry of air into the pocket by the kite's forward motion, and the kite stalls and tips forward under the forward location of the article until the article is released. Alternatively, or in addition the holding and release means are flexible parallel straps cooperating with the keel, or a separate pocket. A weight is provided at the point of attachment of the kite string to the body and cooperates with the pocket to produce a swooping, gliding decending motion of the kite upon release of the tension.

17 Claims, 3 Drawing Sheets

KITE

FIELD OF THE INVENTION

This invention is concerned with a new article dropping kite of the type which may be flown with one or more articles mounted thereon, for example a simulated toy parachutist, and from which the article or articles can be released at will by manipulation of the kite string from the ground by the operator.

REVIEW OF THE PRIOR ART

Parachute dropping kites of various types are known in the prior art, such as those disclosed and claimed in my own prior U.S. Pat. Nos. 4,183,481 and 4,369,939, the disclosures of which are incorporated herein by this reference, including the prior art discussions which they contain. With the kites disclosed in U.S. Pat. No. 4,183,481 the article to be dropped is releasably secured to the kite by a holding means, a releasable closure means being released to drop the article by tugging the kite string while the kite is in flight; the kite does therefore involve a structure which adds to its cost and complexity of operation. With the kites disclosed in U.S. Pat. No. 4,369,939 the article is held by friction in a holding means, usually a pocket, on the kite from which it is released by a sufficiently strong jerk on the kite string; it is sometimes found that the operator will tend to let the kite string slacken just prior to dropping, and it is then difficult to jerk the string sufficiently forcefully to obtain positive release.

DEFINITION OF THE INVENTION

It is the principal object of the present invention to provide a new article dropping kite.

It is a more specific object to provide such a kite that is of relatively simple structure and with which the dropping of the object can be initiated by simple slackening of the kite string.

In accordance with the invention there is provided an article dropping kite comprising:

a kite body;

an article holding and release means connected to the kite body;

a kite string connected to the article holding and release means for extension therefrom to a kite operator;

the article holding and release means comprising two side-by-side flexible members attached to one another and to the kite body at respective first adjacent ends and between which an article to be dropped can be interposed, the flexible members being attached to one another and to the kite string at respective second adjacent ends;

whereby longitudinal tension applied to the flexible members by tension on the kite string urges them toward each other and toward the interposed article to retain the article between them, and release of tension on the kite string permits release of the article from between the flexible members.

Preferably, the kite body includes at least one weight anchor securing area at its trailing edge and flexibly connected to the remainder of the body, for reception of weight anchor means facilitating launch of the kite from the ground with an article retained in the holding and release means.

Preferably also the holding and release means are disposed to retain the article with its weight effective forwardly of the centre of balance of the kite, so that slackening of tension on the kite string with an article held in the holding and release means causes tipping of the kite forwards to facilitate release of the article.

Preferably also the said two flexible members of the holding and release means are constituted by the sides of a keel of the kite attached to the underside of the kite body, the keel providing a flexible-sided pocket of reception of the article to be dropped.

Also in accordance with the invention there is provided a kite comprising:

a kite body;

a kite keel attached to the kite body and providing a forwardly-opening pocket with flexible side walls;

a kite string connected to the kite keel for extension therefrom to a kite operator, whereby longitudinal tension applied to the kite string urges the flexible pocket to close, and forward movement of the kite relative to the ambient air causes the pocket to open and trap air tending to stall relative forward movement of the kite; and a weight member attached to the kite keel and adapted to urge the kite to a flying attitude upon release of the kite string restraint.

DESCRIPTION OF THE DRAWINGS

Particular preferred embodiments of the invention will now be described, by way of example, with reference to the accompanying drawings, wherein.

DESCRIPTION OF THE PREFERRED EMBODIMENTS

Figure 1:
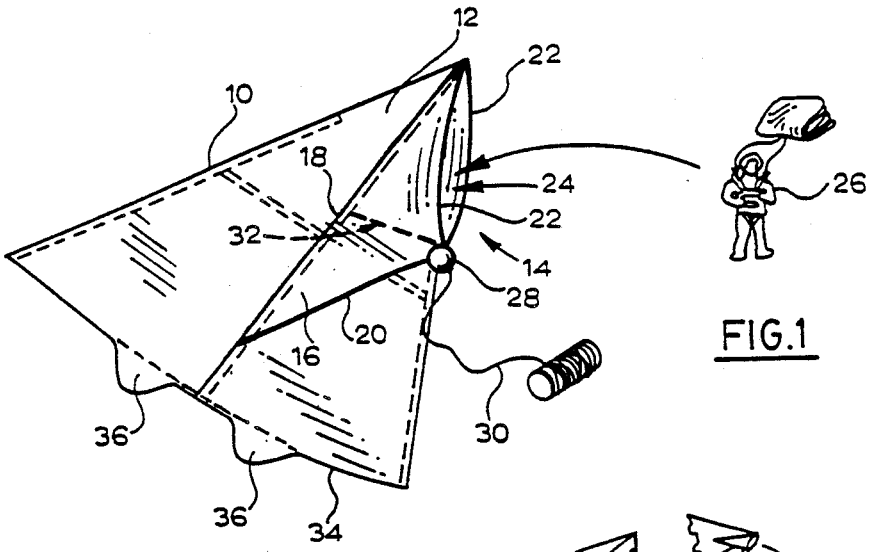
FIG. 1 is a perspective view of a first embodiment showing the kite in typical flying altitude and with an article to be dropped ready for insertion in the article holding pocket thereof.

A "kite" as used herein is intended to include any suitably aerodynamically-shaped article which becomes airborne upon relative movement between itself and the ambient air, as by being towed on a line by a moving operator and/or being held in a moving air stream of sufficient strength by a stationary operator.

Referring now to FIGS. 1 through 5, the first embodiment has a generally triangular body established by frame members 10, to which are fastened thin sheet material 12, such as a vinyl plastic material, to provide the necessary light-weight aerodynamic shape. In this embodiment article holding and release means for the kite are constituted by a downwardly-extending keel member 14 of oblique-angle triangular shape, the member being formed by two triangular flexible side panels 16 joined together along two edges 18 and 20, with the longest pair of edges 18 fastened to the kite body along their whole length, so that the oblique-angle apex is spaced from the kite body by the depth of the keel. The remaining edges 22 are left unfastened so that the keel forms a forwardly-opening pocket 24 into which an object 26, shown as consisting of a toy parachutist, can be inserted. The keel member can instead be formed form a single folded sheet with the fold line providing the edges 18 or 20. A weight member 28 whose function will be described below is fastened to the oblique-angle apex and a kite string 30 has one end also fastened to this apex. The shape of the keel member, is in known manner, made such that with the kite string fastened to the kite at this location the kite body will assume a suitable nose-forward flying altitude when tethered by the string. The surfaces of the body and keel will usually be printed in some decorative manner, for example to simulate a jet plane, space shuttle or the like.

It is preferred to keep the pocket 24 of the holding and release means disposed sufficiently forwardly of the centre of balance of the kite, so that in the absence of tension in the kite string the weight of the article tends to tip the kite forward, and accordingly the two side panels 16 are joined at 32 to make the pocket as deep as possible, while preventing the article being pushed too far into the pocket. It will be understood that a portion of the pocket can be further back than the centre of balance, and it can be positioned relative to this centre and of such shape that a portion of the article is also positioned behind the centre. In other words the arrangement should be such that with the article loaded the front end of the kite is at least just somewhat heavier than the rear end. Since the weight of the article is often as much as that of the kite, and the article is physically smaller, it is the position of the article in the pocket that will predominantly determine the amount of this forward unbalance.

The trailing edge 34 of the kite body is provided with rearwardly-extending flaps 36 that are flexibly pivoted about the trailing edge. These constitute respective weight anchor receiving areas for the reception of weight anchors used to facilitate launching of the kite with an article loaded in the pocket; they will usually be provided with some distinctive decorative and identifying marking.

Figure 2:
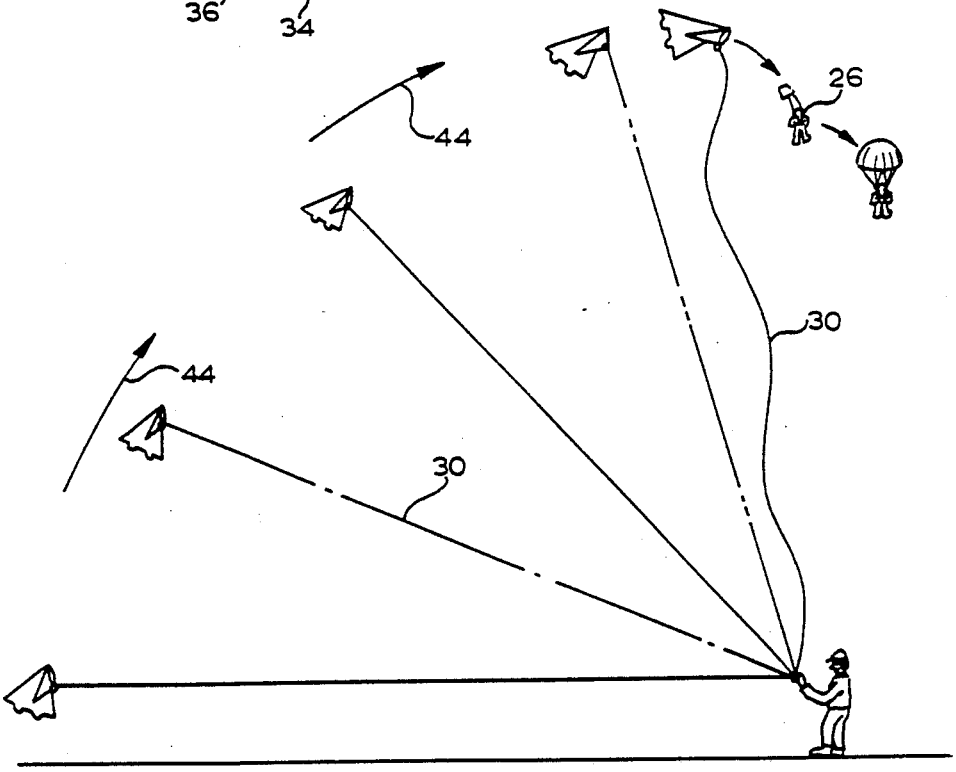
FIG. 2 illustrates a typical sequence of launching of the kite of FIG. 1 from the ground and releasing of an object, consisting of a toy parachutist, from the kite.
Figure 3:
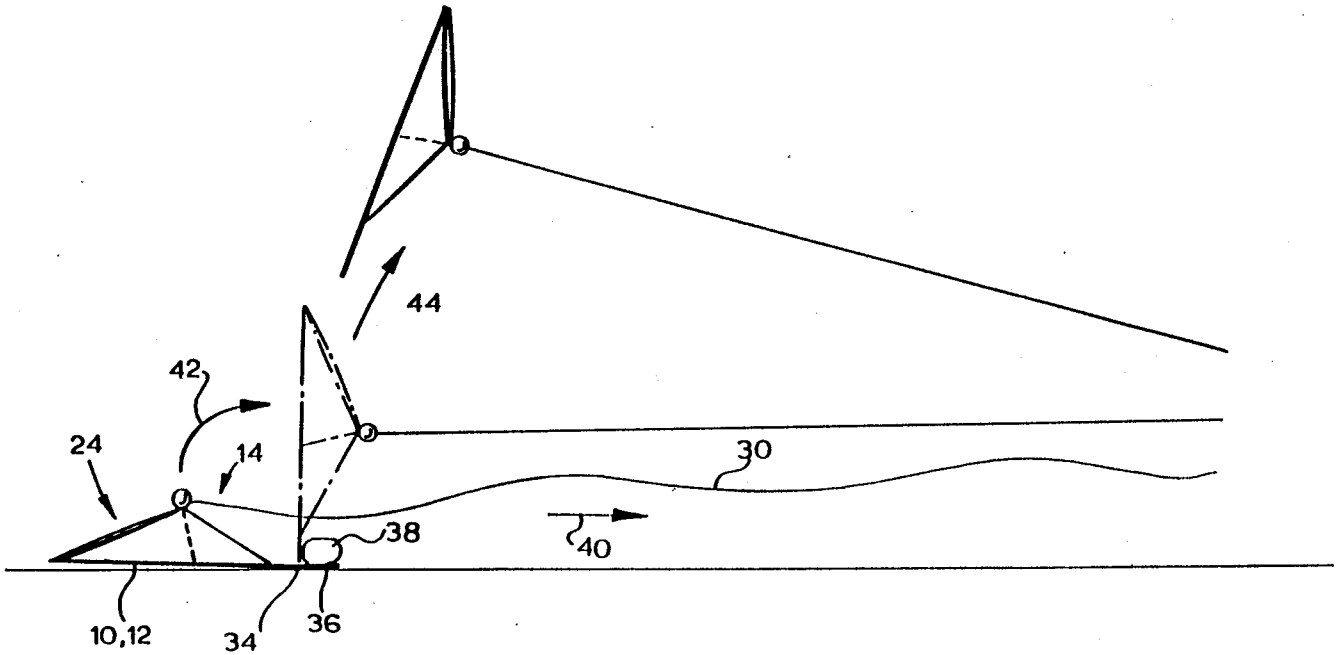
FIG. 3 is to a larger scale than FIG. 2 and illustrates the initial part of the launch sequence just before and after take-off.
Figure 4:
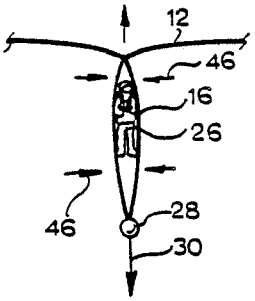
FIG. 4 is a cross-section on the line 4—4 of FIG. 1 to illustrate the manner in which the article is retained in the kite pocket.

The preferred manner of launching the kite is illustrated by FIGS. 2 and 3. The kite body is laid on the ground with the keel pointing upward and two anchor weights 38 are placed in position on the flaps 36; these can be provided as part of the kite kit or can be stones of suitable weight. A suitable length of the string is unreeled in the direction shown in FIG. 2, and is then pulled by the operator in the direction of the arrow 40. During the initial part of the pull the kite is achored by the weights and accordingly rotates about the trailing edge 34 as a pivot axis (arrow 42) until it becomes more or less upright, when it is now in a suitable flying altitude. With a continued pull on the string it pulls out from under the weights, and by now has sufficient relative movement to begin to fly (arrows 44) in an attitude that will retain the parachutist in the pocket.

Figure 5:
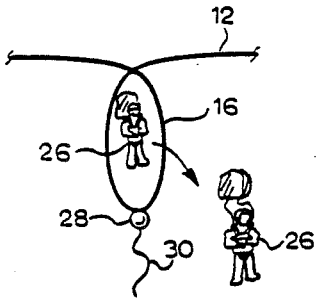
FIG. 5 is a similar cross-section to FIG. 4 to illustrate release of the article from the kite pocket.

As long as the relative wind is sufficient, as by the wind being sufficiently strong or the operator moving sufficiently fast, the kite will climb as illustrated by the sequence of FIG. 1. The kite can therefore easily be launched by a single operator, by relatively small children, and even in the complete absence of wind, although wind is of course desirable. The two flexible triangular side panels 16 of the pocket constitute parallel side members of the holding means that, being interposed between the kite body and the string, are tensioned by the tension on the string, with the result that they are urged toward one another (arrow 46 in FIG. 4) to close the pocket on the parachutist and hold it securely therein. If desired, the pocket interior can be lined with high friction material to increase the retention of the article therein. If at any time the operator allows the string to become slack for a sufficiently long period of time, as illustrated in FIG. 1 at the top of its flight path, the weight of the article will tend to tip the kite to a nose-down attitude. At the same time, with the tension released the pocket tends to open, as illustrated by FIG. 5, this opening being assisted by the air that is forced into the pocket by the relative forward movement of the kite. The parachutist now falls out, permitting its parachute to open for its descent to the ground. The escape is also assisted by any forward motion of the kite at the time that the string is slackened, and the corresponding forward movement of the article as the forward motion of the kite is stalled by the opening of the pocket and the resulting increased air resistance. The kite can then be released or pulled to bring it back down to the ground for re-loading.

The weight 28 can perform an important function during the descent of the kite in the case when the operator simply releases it and allows it to fall, instead of pulling in the string. Upon its release the kite begins to glide downwards and before it can gain any substantial speed (the principal factor that can make a descending kite dangerous) the pocket catches enough air to stall it, when in the absence of the weight it may then drop suddenly. The weight 28 is just sufficient, and is so positioned, that the kite is brought to a flying position; also because it is pulling downward on the pocket side walls, as did the kite string, it tends to close the pocket, and the kite must now gain more speed before the pocket opens sufficiently for another stall. The result is that without any intervention by the operator the kite will descend in a number of slower graceful swoops and stalls that are pleasant to watch and makes it easy for its path to be followed and avoided, if necessary. In this mode the toy is more accurately regarded as a glider, but is still within the "kite" definition given in this application. This makes a very pleasing toy even if not used for release of an article.

Other embodiments of the invention are illustrated by FIGS. 6 through 9. Although in the first embodiment the kite body is constructed in conventional form using rigid frame members, it can instead be of frameless type construction consisting for example of an inflated body that is pressurized sufficiently to provide the necessary rigidity.

Figure 6:
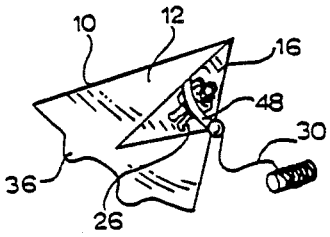
FIGS. 6 through 9 illustrate further embodiments.

FIG. 6 shows an embodiment in which the holding and releasing means comprise the flexible kite keel and two parallel flexible straps 48 (only one shown), one on each side of the keel, each strap and the adjacent side of the keel constituting a separate holding and release means. In an embodiment which is not illustrated the holding and release means comprise two parallel flexible straps separate from the keel, if a keel is provided at all, between which the parachutist is retained; in such an embodiment it may be more important to provide high friction surfaces that engage the article to ensure its retention in the holding means.

Figure 7:
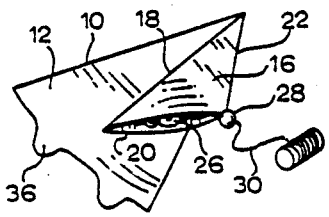

In the embodiment of FIG. 7 the pocket is formed in the rear end of the keel, the front edges 22 being sealed together, while the edges 20 constitute the mouth of the rear-opening pocket. In this embodiment a weld 32 is not necessary, but can of course be provided if desired.

Figure 8:
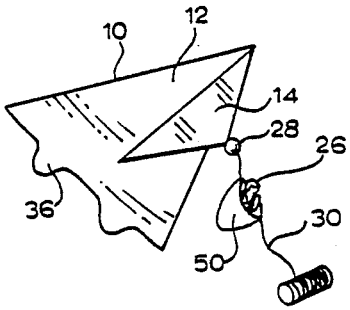

In the embodiment of FIG. 8 a pocket 50 is formed separately from the keel and is connected between the keel apex and the kite string; the function of the pocket in holding and release is unchanged, and the keel can also be made in the form of a pocket or not, the pocket keel being preferred. With this and the other embodiments the pocket can be sufficiently deep that the article is totally enclosed therein and the tension on the string tends to draw the mouth of the pocket closed, so that it can be considered as bag-like; the article will still escape when the tension is released and the mouth of the bag opens.

Figure 9:
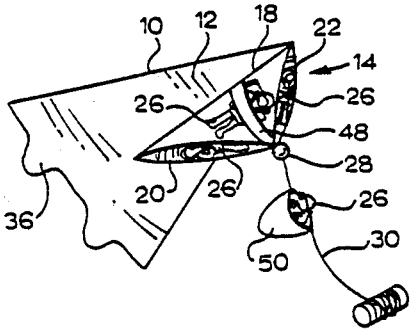

The embodiment of FIG. 9 employs all of the holding and release means of the preceeding embodiments to provide a kite toy that can load and release up to five parachutists 26 at one time. In a further embodiment, for which FIG. 9 can serve as an illustration, with or without the straps 48, both the forward edges 22 and the rearward edges 20 are left open and a weld 32 is not provided, so that the pocket extends from front to back, and with only a single parachutist provided it can be loaded through either of the front or rear openings. This does provide a toy in which the operator is not sure which opening will discharge the device, adding to its interest in playing.

Although in the embodiments illustrated two separate anchoring areas 36 are provided, other temporary anchoring arrangements can be employed, such as a long weight that extends lengthwise of the trailing edge 34. Although in these embodiments two triangular panels of equal size are used to form the keel and also the pocket, this is not necessary for successful implementation of the invention, and one panel can be larger than the other as long as the pocket formed is adequate to receive and release the article.

I claim:

1. An article dropping kite comprising:

a kite body;

an article holding and release means connected to the kite body;

a kite string connected to the article holding and release means for extension therefrom to a kite operator;

the article holding and release means comprising two side-by-side flexible members attached to one another and to the kite body at respective first adjacent ends and between which an article to be dropped can be interposed, the flexible members being attached to one another and to the kite string at respective second adjacent ends;

whereby longitudinal tension applied to the flexible members by tension on the kite string urges them toward each other and toward the interposed article to retain the article and release of tension on the kite string permits release of the article.

2. An article dropping kite as claimed in claim 1, wherein the kite body includes at least one weight anchor receiving area at its trailing edge and flexibly connected to the remainder of the body, for reception of weight anchor means facilitating launch of the kite from the ground with in article retained in the holding and release means.

3. An article dropping kite as claimed in claim 1, wherein the holding and release means are disposed to retain the article with its weight effective forwardly of the centre of balance of the kite, so that slackening of tension on the kite string with an article held in the holding and release means causes tipping of the kite forwards to facilitate release of the article.

4. An article dropping kite as claimed in claim 2, wherein the holding and release means are disposed to retain the article with its weight effective forwardly of the centre of balance of the kite, so that slackening of tension on the kite string with an article held in the holding and release means causes tipping of the kite forwards to facilitate release of the article.

5. An article dropping kite as claimed in any one of claims 1 to 3, wherein the said two flexible members of the holding and release means are constituted by the flexible sides of a keel of the kite attached to the underside of the kite body, the keel providing a flexible pocket for reception of the article to be dropped.

6. An article dropping kite as claimed in any one of claims 1 to 3, wherein the said two flexible members of the holding and release means are constituted by the flexible sides of a keel of the kite attached to the underside of the kite body, the keel providing a flexible forwardly-opening pocket for reception of the article to be dropped.

7. An article dropping kite as claimed in claim 1 wherein the said two flexible members of the holding and release means are constituted by the sides of a flexible pocket attached to the underside of the kite body.

8. An article dropping kite as claimed in claim 1 wherein the said two flexible members of the holding and release means are constituted by the sides of a forwardly-opening flexible pocket attached to the underside of the kite body.

9. An article dropping kite as claimed in any one of claims 1 to 3, wherein the said two flexible members of the holding and release means are constituted by the sides of a forwardly-opening add a rearwardly opening flexible pocket or respective pockets attached to the underside of the kite body.

10. An article dropping kite as claimed in claim 1 wherein the said two flexible members of the holding and release means are constituted by two parallel straps.

11. An article dropping kite as claimed in any one of claims 1 to 3, wherein the said two flexible members of the holding and release means are constituted by the sides of a flexible pocket attached to the underside of the kite body, add by two parallel straps extending on respective sides of the sides of the flexible pocket, so that a first article can be carried in the pocket, and another article can be held between a respective strap and the immediately adjacent pocket side.

12. An article dropping kite as claimed in claim 1 wherein the kite is provided with a weight member adapted to urge the kite to a flying attitude upon release of the kite string restraint.

13. An article dropping kite as claimed in claim 1 wherein the kite is provided at the point of attachment of the kite string to the kite with a weight member adapted to urge the kite to a flying attitude upon release of the kite string restraint.

14. An article dropping kite as claimed in claim 1 wherein the holding and release means are constituted by forward-opening pocket in a keel of the kite, and wherein the kite is provided with a weight member adapted to urge the kite to a flying attitude upon release of the kite string restraint.

15. An article dropping kite as claimed in claim 1 wherein the holding and release means are constituted by forward-opening pocket in a keel of the kite, and wherein the kite is provided at the point of attachment of the kite string to the kite with a weight member adapted to urge the kite to a flying attitude upon release of the kite string restraint.

16. A kite comprising:

a kite body;

a kite keel attached to the kite body and providing a forwardly-opening pocket with flexible side walls that permit the pocket to open and close;

a kite string connected to the kite keel for extension therefrom to a kite operator, whereby longitudinal tension applied to the kite string urges the flexible pocket to close, and forward movement of the kite relative to the ambient air in the absence of said longitudinal tension causes the pocket to open and trap air tending to stall the said relative forward movement of the kite; and a weight member attached to the kite keel to urge the kite to a flying attitude and also to close the pocket by its weight in the absence of said longitudinal tension, whereby upon a stall the kite tends by the action of the weight to resume forward flying movement which will again cause the pocket to open and again tend to stall the kite, so that the kite tends to descend to the ground with a series of such stalls.

17. A kite as claimed in claim 16, wherein the weight member is provided at the point of attachment of the kite string to the kite keel.

* * * * *